US008858351B2

(12) United States Patent
Crawford

(10) Patent No.: US 8,858,351 B2
(45) Date of Patent: Oct. 14, 2014

(54) OPERATING SHOW OR RIDE ELEMENTS IN RESPONSE TO VISUAL OBJECT RECOGNITION AND TRACKING

(75) Inventor: David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 1631 days.

(21) Appl. No.: 12/127,621

(22) Filed: May 27, 2008

(65) Prior Publication Data

US 2009/0298603 A1 Dec. 3, 2009

(51) Int. Cl.

| | |
|---|---|
| ***A63G 33/00*** | (2006.01) |
| ***A63G 7/00*** | (2006.01) |
| ***A63G 4/00*** | (2006.01) |

(52) U.S. Cl.

CPC ... *A63G 4/00* (2013.01); *A63G 7/00* (2013.01)
USPC ..... 472/137; 463/30; 463/31; 463/32; 472/55; 472/56; 472/60

(58) Field of Classification Search

CPC ..... A63G 31/00; A63G 33/00; A63H 3/28; G06K 9/00
USPC ..... 463/1–6, 30–33, 40–42; 472/1–6, 12, 472/29, 51–56, 60, 137
See application file for complete search history.

(56) References Cited

U.S. PATENT DOCUMENTS

| | | | | |
|---|---|---|---|---|
| 6,060,847 | A | 5/2000 | Hettema et al. | |
| 6,186,902 | B1 * | 2/2001 | Briggs | 472/117 |
| 2005/0105769 | A1 | 5/2005 | Sloan et al. | |
| 2005/0215171 | A1 | 9/2005 | Oonaka | |

OTHER PUBLICATIONS

"Animation Engine for Believable Interactive User-Interface Robots" written by van Breemen , 2004.*
PCT International Search Report, International application No. PCT/US2009/041250, international filing date Apr. 21, 2009.

* cited by examiner

*Primary Examiner* — Ronald Laneau
*Assistant Examiner* — Ross Williams
(74) *Attorney, Agent, or Firm* — Marsh Fischmann & Breyfogle LLP; Kent A. Lembke

(57) ABSTRACT

A ride or show control apparatus using visual recognition to provide a more interactive experience to guests or participants. The apparatus is adapted for operating a ride or show element, such as a robotic character. The apparatus includes a mechanized or robotic element with movable components positioned near a guest traffic area. The apparatus includes an imaging assembly capturing images of the traffic area and outputting digital image data. A controller is provided that includes a processor using an object recognition module to process the image data to determine whether an object is in the traffic area. In response to the object recognition, the control system operates movable components of the mechanized element such as to cause it to speak or move in the direction of the recognized object such as a visitor's face or a badge, hat, or other item worn or carried by a guest or participant.

12 Claims, 5 Drawing Sheets

OPERATING SHOW OR RIDE ELEMENTS IN RESPONSE TO VISUAL OBJECT RECOGNITION AND TRACKING

FIELD OF THE INVENTION

The present invention relates, in general, to theme or amusement parks and the use of robotics and similar mechanized figures to entertain guests, and, more particularly, to methods and systems for providing figures in rides, show/ride queues, and elsewhere that are more responsive to park/attraction visitors or guests.

RELEVANT BACKGROUND

Theme and other amusement park operators are under ongoing pressure to create new rides and shows to entertain park visitors. Many parks include rides with show portions that may be provided to tell a story and such show portions may provide a theme to the ride or attraction. The show portion may include music and video portions to entertain the park visitors as their vehicle passes through a portion of a tunnel or stretch of the ride. In many rides, action is provided in the show with robotics or other mechanisms that move characters or other objects as a vehicle passes nearby. For example, an animal such as a lion or bear may move its head and open its mouth to roar as a vehicle full of guests passes by on a track. In other cases, a character may perform actions such as talking along with a soundtrack or move in particular manner or based on a routine in the presence of the vehicle. Some rides have a long queue or pre-show section and animated characters or mechanisms may be provided that periodically operate to entertain the guests. Technology such as robotics may be used by ride or show designers to provide these creatures and characters and other moving objects/structures in a very realistic manner, e.g., with body and facial movements that correspond closely to live animals, humans, and the like.

While show or ride characters may be realistic, people quickly lose their belief (or their suspension of disbelief) with relation to mechanized or robotic figures or show/ride equipment. One problem with existing show figures and equipment is that it may be operated simply as a constant and repeating effect. For example, a show or pre-show effect may involve a robotic creature, figure, or statue that is periodically activated to perform a routine or a number of actions with or without an accompanying soundtrack. In many cases, the ride or attraction visitors or guests may be entertained upon first seeing the creature operate, but the effect may be ruined or weakened when it is repeated before they have left the area (e.g., the pre-show queue does not move fast enough to place them out of the sight or hearing range).

In other rides, figures or show equipment is synchronized with the operation of the ride. For example, a show segment may be initiated when a vehicle travels across a certain point of a track such as may be determined by a triggering mechanism or a sensor. When initiated, one or more robotic figures perform a preprogrammed or choreographed set of movements. Unfortunately, accurate synchronization of show equipment with ride vehicles and guests in the vehicles is typically not achieved with such a system. Instead, the show equipment such as a robotic character is designed to perform to a theoretical or predicted vehicle position and the presence of an average passenger. Specifically, a character does not look directly at or speak to any particular passenger but, instead, in the general direction of the detected vehicle.

The show equipment also behaves the same if a vehicle is empty, which causes riders in nearby vehicles to recognize that the characters or other equipment is not interactive or responsive to the presence of people in the vehicles (e.g., is a robot rather than a live character). Typically, show systems of a ride run a pre-programmed motion profile to cause characters and other objects to move in a timed manner (e.g., repeat motion profile periodically) or off a triggered event or sensor trigger. The show systems generally do not vary this motion profile or its cycling, and since equipment runs whether vehicles are loaded with guests or not and in a repetitive manner, guests are able to identify the repetitive and non-responsiveness of the show equipment, which can detract from their enjoyment of the show portion of the ride. For example, a guest in a trailing vehicle may think a show is not very realistic if a figure is talking to or making threatening gestures toward an empty vehicle. The cycling of show equipment can also increase wear and maintenance costs as the equipment repeats show movements even when there are no guests/visitors in the adjacent vehicle or, in a pre-show setting, in the immediate area.

In some cases, an actor is placed among the robotic show equipment to create a realistic and responsive effect as the actor can interact directly with particular vehicle passengers. Similarly, a ride operator may act to control one or more portions of the show equipment such as a robotic character to cause it to interact with guests and, in some cases, the operators voice is broadcast from the character to allow the character to talk responsively to a guest. The use of live characters and interactive robots is largely popular among the park visitors, but the use of operators and live actors on an ongoing basis is typically very expensive.

There remains a need for methods and systems for providing improved show or entertainment equipment. Preferably, such methods and systems would provide equipment, such as robotic-based characters or systems, that are more synchronized and/or interactive with guests or visitors.

SUMMARY OF THE INVENTION

Embodiments of the present invention are directed toward use of visual recognition technology to provide rides and shows that are more interactive with guests or participants. For example, an embodiment may provide an apparatus for use in operating a ride or show element, such as a robotic figure or character, to interact in a more realistic manner with people in a guest traffic area (e.g., in a vehicle traveling along a track through such an area or visitors of a park walking on a path or in a line or queue area). The apparatus may include a mechanized or robotic object/element with one or more movable components that is positioned near the guest traffic area, e.g., a robot or robotic statue positioned near a vehicle track or near a high traffic area of a park or entertainment facility. The apparatus may further include an image capture assembly using a camera and/or other devices to capture images of the traffic area and to output digital image data. A controller or control system is included in the apparatus and uses a processor to run an object recognition module to process the image data so as to recognize or determine whether an object is positioned in the traffic area. In response to the object recognition, the control system operates the mechanized object or element, e.g., the mechanized object may be a robotic figure and the responsive operating may include causing the robotic figure to speak, sing, or point in the direction of the recognized object or guest wearing or holding such an object.

The control system may also include (or have access to) memory that stores data related to a set of search objects such as buttons or badges, clothes of a particular color and/or style, hats, or other worn items and/or maps, keys, balloons, or other carried/held items. These items may be objects learned by the object recognition module and/or be predefined or items known by the object recognition module. During operation, the control system acts to determine whether any of the search objects are present in the guest traffic area by processing the output image data (or the control system may be programmed to only react when 2 or more search objects are present or to look for objects in a subset of the larger set of search objects). Sets of scripted actions may also be stored in memory and one or more of such scripted actions may be associated with each of the search objects. Then, when the object recognition module identifies or recognizes one of the search objects, the control system may act to retrieve the associated script and cause the mechanized object or show element to perform the actions defined in the script (e.g., sing a song, speak a recorded message, wave arms at a guest, or the like). The object recognition module may include or utilize existing or to be developed robotic vision systems that support object recognition, e.g., ViPR™ visual pattern recognition technology or enabled-devices distributed by Evolution Robotics, Inc.; Selectin™ suite of tools for machine vision or devices enabled with Selectin™ distributed by Energid Technologies Corporation, or the like.

The control system may also include an object tracking module that is run or used by the processor to track a physical location or position of the determined object within the guest traffic area, and the control system then would in some cases operate the mechanized object or element at least partially responsive to the tracked physical position of the recognized object (e.g., turn a head or body to follow a person in a moving vehicle or have eyes of a robotic creature follow a guest walking by the creature). In some cases, the recognized object may be a human face, and the control system may operate the mechanized object or element only when a human face is detected in the guest traffic area such as to only operate a robotic figure when a passing ride vehicle is carrying passengers and not to an empty vehicle. The object tracking module may include or utilize existing or to be developed robotic vision systems that support object recognition, e.g., Selectin™ suite of tools for machine vision or devices enabled with Selectin™ distributed by Energid Technologies Corporation, object tracking software and tools developed/available from Mitsubishi Electric Research Laboratories (MERL), or the like.

DETAILED DESCRIPTION OF THE PREFERRED EMBODIMENTS

Briefly, embodiments of the present invention are directed to systems, and associated methods, for operating show elements such as robotic figures and objects to entertain guests/visitors using visual object recognition technology. Visitors of theme and amusement parks and other entertainment facilities find robots and other show elements more entertaining and enjoy an experience more when the show elements appear real and when the show elements behave unexpectedly, provide interaction, and/or act in a directed or personalized manner (e.g., acting in a personalized manner is important to many designers as they try to give a guest/visitor an individual experience as opposed to a more typical generic experience). The use of live actors as show elements and providing human operators of show elements to control the elements in real time have been used to provide unique show/ride experiences, but such operations are typically too expensive to use during all operating hours and have often just been used sporadically (e.g., sometimes it is difficult to staff properly since there is a need for specialized or highly trained talent to interact with guests/visitors in a desired manner). The methods and systems described herein replace (or supplement) live actors and operators with a show/ride/attraction control system that is configured with object recognition technology (e.g., image capture equipment, image processing software/processors recognizing objects, and the like) so that show elements may be operated in response to recognition to an object such as by operating a robot to perform a set of choreographed actions. For example, visual recognition of a 3D object within a vehicle such as a hat, a pin, an article of clothing, or other worn/carried item may be used to trigger a robotic character to talk to passengers of a vehicle (e.g., to talk to a particular one of passengers/guests in the vehicle with or without object tracking or at least in the general direction of an occupied vehicle rather than to every vehicle regardless of whether a vehicle is empty, as occurs with many other ride controllers that simply sense presence of a vehicle).

The description begins with a description of an exemplary ride/show system followed by an object training and an operating method with use of visual object recognition for use with the ride/show system. The description then provides two examples of systems that implement object recognition in show element controllers/control systems to achieve desired entertainment effects.

Figure 1:
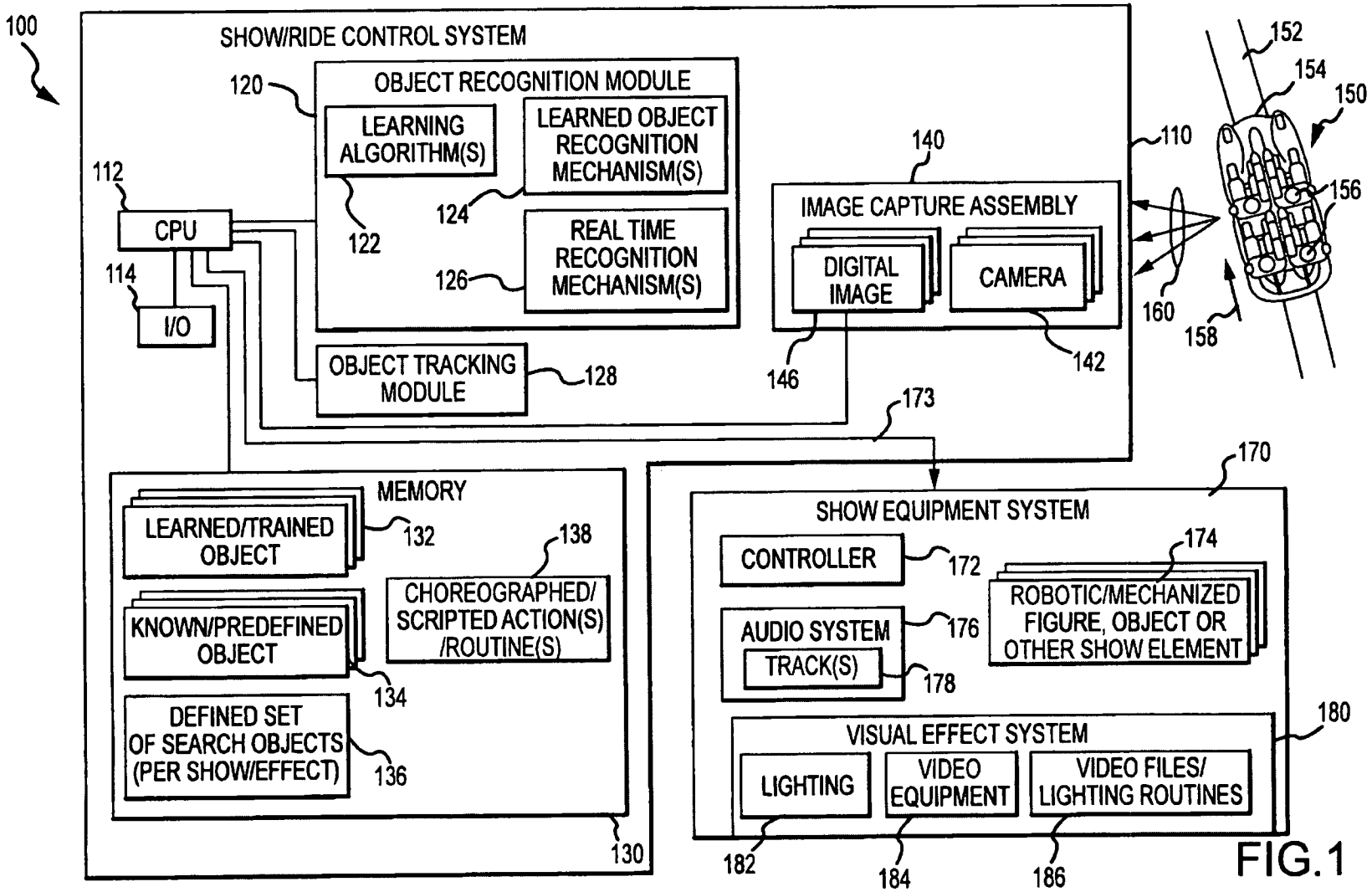
FIG. 1 is a functional block diagram of a system for use with a ride, show, or attraction to provide robotic and/or mechanized equipment operated in response to object recognition.

FIG. 1 illustrates a system 100 that may be used in rides, shows, theaters, attractions, and many other entertainment environments that involve visitors or guests passing show elements such as a ride that moves vehicles of passengers by a set of show elements or a queue or waiting area where park guests walk by show elements. For example, a roller coaster or a water ride may include a show section in which the vehicles are passed at slower speeds (e.g., less than about 20 miles per hour and often just several feet per second) through a show portion of the ride such as a darker tunnel-like area. In this show portion of the ride, robotics and other show elements such as video equipment, audio equipment, lighting systems, special effects (such as air/wind, fog, and so on), and the like may be provided to entertain guests in the vehicles. Also, many entertainment settings such as show or attraction waiting areas or queues include show elements such as robots or robotic characters (such as a statue, an animal, a character from a movie/show, and so on) to help entertain the waiting guests/visitors.

The system 100 includes a show/ride/attraction control system 110, which may communicate with a larger controller or control system (not shown), adapted for selectively operating or controlling operation of a show equipment system 170. As shown, the show equipment system 170 is positioned adjacent or proximate to a vehicle and track assembly 150 that includes a track 152 defining a path for a vehicle 154 to travel through the system 100. Typically, the vehicle 154 carries one or more passengers or guests 156 at a particular ride speed 158 (e.g., a relatively predictable speed in a known range for the show portion of the track 152 near the show equipment system 170). The show equipment system 170 may include a controller 172 that powers and otherwise signals/controls operation (such as per a preset routine 138) of show elements, which may take numerous forms to practice the invention. In this example, the show elements include one or more robotic or mechanized figures or objects 174, an audio system 176 for playing audio tracks 178 (e.g., voice tracks for a character 174, music to accompany movement of the figures/objects 174, sound effects to suit operation of an object such as firing of a cannon, closing a door, and so on), and a visual effect system 180 that may include lighting 182, video display/projection equipment 184, and video files/lighting routines 186 for use in operating the lighting 182 and display equipment 184 (e.g., lighting and/or video/still imagery may be operated/displayed to enhance a show performed or created by operation of the show elements 174). Many other effects may be included in these special effects for triggering by object recognition such as air/wind, fog, water-based effects, and the like, and the invention is generally directed to triggering an effect such as a robotic movement/action based upon object recognition.

The show/ride control system 110 includes a processor or CPU 112 for running software/code and otherwise controlling operation of a computer system such as memory devices, communication modules, and the like. The control system 110 includes input/output (I/O) devices 114 such as a keyboard, a mouse, touch screen, and the like to allow a user or system operator to enter data such as to operate the system 110 to learn 3D objects (e.g., see the method 200 of FIG. 2) to recognize them in or near vehicle 154 and to select which show elements 174, 176, 180 will operate in response to an object being recognized/identified, and what actions/functions each of such show elements will perform in response to the object recognition.

Significantly, the control system 110 includes an object recognition module 120 (e.g., object recognition technologies/modules/tools from Evolution Robotics, Energid, and other object recognition software/tool developers/distributors) that is run or executed by the CPU 112 during operation of the system 110 and, optionally, an object tracking module 128 (e.g., object tracking modules/technologies/tools available from Energid, MERL, or other object tracking software or tool developers/distributors). The control system 110 further includes an image capture assembly 140 that includes one or more digital cameras 142 (which in some embodiments are provided in the robotic figures or objects 174 such as the eye(s) of a robot) that are targeted on the show portion of the ride and track assembly 150 to capture a stream of images 160 that are shown to be temporally stored at 146 and that generally include still and/or video images (e.g., digital images) of the vehicle 154 and, more importantly, of the passengers 156 within the vehicle 154. The digital images 146 may be stored in memory 130 of the control system 110 and are processed by the object recognition module 120 and, optionally, by the object tracking module 128 to allow the control system 110 to visually recognize objects in the show area of ride and track assembly 150 and, optionally, to track that object as the vehicle 154 moves 158 along the track 152 and move all or a portion of the element 174 to follow the tracked object.

The methods of the invention may also be thought of as computer-based or implemented methods as the control system 110 typically is configured with software and hardware to provide all or many of the process steps involving object recognition and show element control/operations. The functions and features of the invention are described as being performed, in some cases, by "modules," "mechanisms," routines, and so on that maybe implemented as software running on a computing device and/or hardware/electronic components. For example, the show element control methods, processes, and/or functions described herein may be performed by one or more processors or CPUs running software modules or programs such as object learning algorithms, visual object recognition algorithms, object tracking routines, and the like. The methods or processes performed by each module are described in detail below typically with reference to functional block diagrams, flow charts, and/or data/system flow diagrams that highlight the steps that may be performed by subroutines or algorithms when a computer or computing device runs code or programs to implement the functionality of embodiments of the invention. Further, to practice the invention, the computer, network, and data storage devices and systems may be any devices useful for providing the described functions, including well-known data processing and storage and communication devices and systems such as computer devices or nodes typically used in computer systems or networks with processing, memory, and input/output components, and server devices (e.g., computers and computing device specially configured to implement the functions describe herein such as the methods 200 and 300 of FIGS. 2 and 3) configured to generate, store, process, output, and transmit digital data over a communications network. Data typically is communicated in a wired or wireless manner over digital communications networks such as the Internet, intranets, or the like (which may be represented in some figures simply as connecting lines and/or arrows representing data flow over such networks or more directly between two or more devices or modules) such as in digital format following standard communication and transfer protocols such as TCP/IP protocols. The particular format for data that is captured, processed, and stored is not limiting to the invention and may take nearly any useful for (e.g., the image data 146 captured by the camera 142 may take any of a number of formats for digital images that may be still images or video images).

The object recognition module 120 may include one or more learning algorithms or routines 122 that enable the object recognition module 120 to learn 2D and, more typically, 3D objects, and the control system 110 may include memory or data storage 130 for storing the learned objects 132 (e.g., store a name or ID of such image along with, any "learned" data that is used by the object recognition module 120 for later recognizing that object). The object recognition module 120 further includes a learned object recognition mechanism(s) 124 that operates based on its training anchor use of learned/trained objects data 132 to process image data 146 to identify or recognize objects in the ride and track assembly 150. Further, the object recognition module 120 may include a real time recognition mechanism or routine 126 that functions to identify one or more objects without further training. For example, the recognition mechanism 126 may include software routines that allow the module 120 to process images 160 to identify that a person 156 is in the vehicle or to determine the presence and location, of a human face. These recognized or known objects identified by mechanism 126 may be found/identified based on sets of known or predefined object 134 definitions stored in memory (e.g., similar to training that has occurred previously for the module 120 or the like) or the real time recognition mechanism 126 may include algorithms/routines with intelligence/logic to identify one or more objects without further data 134.

In addition to recognizing an object, the module 120 may be configured to determine a location relative to the camera 142 of the recognized object. The object tracking module 128 may be used by the control system 110 to determine a physical location of the recognized object over time, e.g., to begin with the initial position and then maintain an updated physical location of the object as the vehicle 154 travels 158 along the track 152. Such object tracking or an object's position relative to the camera 142 may be used by the control system 110 (or by a choreographed/scripted action or routine) to operate a show element 174 such as by having all or a portion of a robotic character turn or move with the moving object (e.g., move an outstretched arm with a particular object, move a robot's eyes or head with the object, and so on).

As shown, the memory 130 also is used to store a defined or selected set of search objects 136 for use by the control system 110 in operating the show equipment system 170. For example, an operator of the control system 110 may use the I/O 114 (e.g., a user interface displayed on a monitor or the like) to choose one or more (e.g., a set) of the learned objects 132, the known/predefined objects 134, or objects recognizable by real time module 126 in image data 146. For example, an operator may place a learned balloon shape and/or color from the learned objects 132 in the set of defined search objects 136 and also a human form or face from the known objects 134 for identification by the real time recognition mechanism 126.

Each of such sets 136 may be associated with one or more show elements 174, 176, and/or 180. The memory 130 may also store one or more choreographed or scripted actions/routines (or show segments) 138 that define actions/movements of show elements 174 and may also define sound tracks 178 and/or visual effects (such as lighting 182 and/or video equipment operations as defined by one or more video/lighting files 186). Further, the operator may use the I/O 114 or other devices to assign or associate one or more of the predefined/scripted actions (or show segments) 138 to one or more of the show elements 174, 176, 180 for one or more of the defined set of search objects 136. For example, a robotic figure 174 may be lit by lighting 182 and operated to talk (e.g., move at least its mouth) along with an audio track 178 played by audio system 176 when a particular object is recognized from the set of search objects 136 near the robotic figure 174 location (e.g., when the vehicle 154 is near the robotic figure 174). The assigned actions 138 may vary for a particular show element 174 with the recognized object 136 (e.g., take one action if recognize a pin or badge, another if spot a balloon, and another if identify a red shirt). Hence, the variations of operation of the system 100 are numerous as the combination of the show equipment 170 may be varied as may the objects in the search set 136 and the assignment of a wide variety/number of responsive/interactive actions/routines 138.

Figure 2:
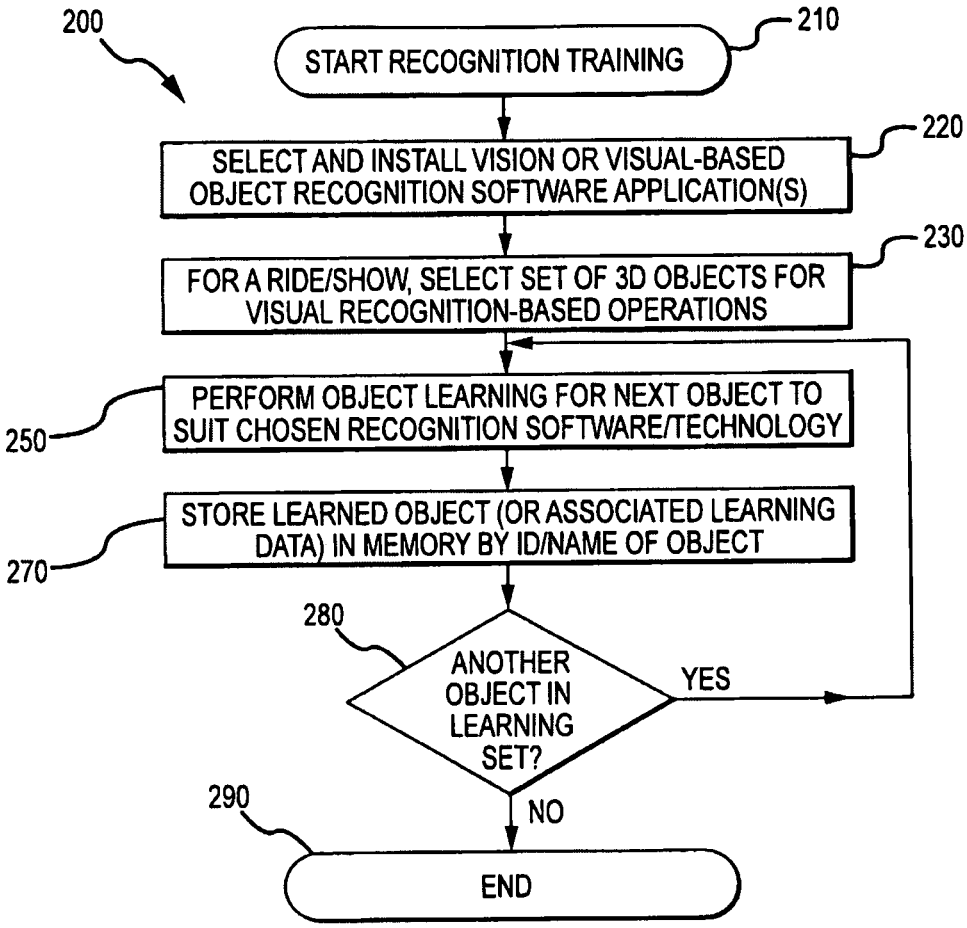
FIG. 2 illustrates a flow diagram for a method of performing object recognition training for use with ride/show/attraction systems such as the system of FIG. 1 (e.g., for training the object recognition module and/or control system)

As shown in FIG. 1, the object recognition module 120 may include one or more learning algorithms 122. FIG. 2 illustrates a method 200 for training the recognition module 120 to be able to identify objects (e.g., 2D and, more typically, 3D objects). The training 200 starts at 210 such as with definition of the operational needs and/or functionalities of the recognition module 120. This may include determining what type of objects are to be recognized, the operating conditions such as lighting levels and quality/type of image data to be processed by the recognition module, the speed of recognition required (e.g., how fast is the vehicle 154 traveling past as shown at 158), and other design and operating criteria. At 220, a vision or visual-based object recognition software application 120 (and, in some cases, hardware such as particular processors, particular cards and/or chips, and image capture equipment 140) is chosen for use in an application such as ride system 100 of FIG. 1. Step 220 also includes installing the recognition application 120 upon the control system 110 and, when necessary, configuring system components and/or initializing the application 120.

At step 230, the method 200 continues with selecting a set of 3D objects for use in the visual recognition-based operations of a ride, show, or attraction. In some cases, this may be all or just a subset of the entire set (e.g., a subset of search objects 136 with the others being predefined as default objects with the selected software application 120 and/or identifiable with included real time algorithms 126 such as a human form or face). For example, at step 230 an operator chooses an object worn or carried by a passenger such as a pin or badge that provides information about the guest/passenger (e.g., a birthday pin, a girl pin or boy pin, a badge of honor or of playing a particular part in a show/theme ride, and so on) or an object that is handed to a guest/visitor in a queue (e.g., a treasure map, a balloon, and so on).

At step 250, the method 200 continues with performing object learning for the next object in the set of search objects chosen in step 230. The learning 250 is carried out to suit the particular recognition software 120 and its learning algorithm 122. Object learning 250 may include memorizing the object or an image of the object. In such a learning phase 250, the algorithms 122 may process a digital image of the object and extract specific features (such as from a video stream or a single still image), and these extracted features may be stored at 270 in memory 130 such as a model or model template 132 of the object, with an ID or name of the object.

In some cases, there may be more information in the video or still image data than just the target search object, and the background and an object holder are typically kept as simple as possible (such as a static, gray or white background) and the background information can be identified by an operator or be learned previously by the learning algorithms before insertion of the object as not being part of the target search object. The object typically is viewed/filmed and then learned from a number of angles, directions, and orientations so that the learned object can later be identified or recognized in video or still image data in any of those learned positions (e.g., a learned badge/pin would be recognizable right-side up or upside down and when placed orthogonal to the camera as well as a range of angles). Note, the learning at 250 may include learning colors and color may be a distinguishing factor such that a robotic figure or other show element may react differently to a recognized red hat versus a green hat, to a recognized gold badge versus a black badge, and so on. The method 200 continues at 280 with determining if there are additional objects to be learned in the learning set. If yes, the method 200 continues at 250 with learning additional objects and storing the learned objects and/or object features with an ID) 132 in memory 130. If not, the method 200 may end at 290.

Figure 3:
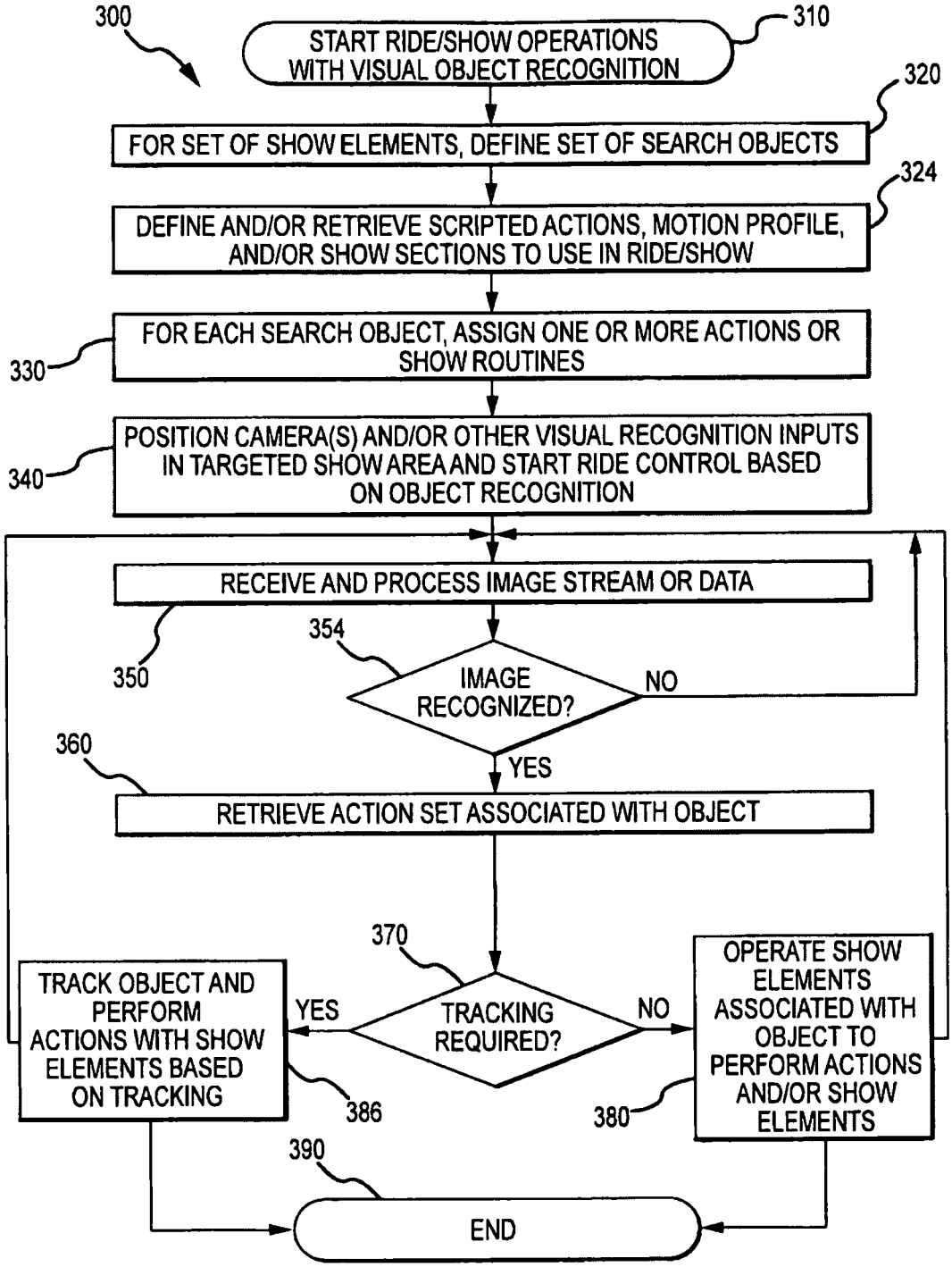
FIG. 3 illustrates a flow diagram for a show/ride/attraction operating method of an embodiment of the present invention that makes use of visual object recognition and, in some embodiments, object tracking to control show elements such as robotic figures or objects.

FIG. 3 illustrates a representative operating method 300 for the system 100 (and other systems/embodiments of the invention). The method 300 may start at 310 such as with performing the method 200 of FIG. 2 including selecting one or more object recognition tools, installing them on or providing access to such tools/applications from a ride control system, selecting and providing visual or image data capture equipment, and choosing portions of a ride/attraction/show to use object recognition as well as for which parts of the show elements (e.g., only one robot in a group of robots may be operated with object recognition or a subset of robotic figures may be so operated). At step 320, a set of search objects 136 is defined for each or sets of the show elements. Note, differing search objects 136 may be assigned to or associated with differing show elements or these may be shared or overlap (e.g., all show elements on a ride that are triggered based on object recognition may respond to a particular hat purchased at the park, react to a badge/pin/jewelry, and so on or one show element may react to a pin/badge while another reacts to blue clothing, with the variations being too numerous to define here in detail).

At step 324, a set of scripted actions, motion profiles, and/or show segments are retrieved and/or otherwise defined for use in a ride, show, or entertainment attraction. For example, a motion profile and audio track 138 for a robotic character 174 may be defined that causes the character to dance and sing, with an audio track 178 associated with the song such that the character 174 may lip sync the song. In another case, a show segment may cause a robot band to play a song such as a birthday-related song by defining an audio track 178 to be played by audio system 176, a lighting routine 186 to cause visual effect system 180 to operate lights 182, and a set of robotic figures/objects 174 to play the band members based on motion profiles 138. At step 330, for each search object chosen in step 324, one or more of the actions/routines defined in step 324 is assigned and the combination or pairing of the search object 136 and action/routine 138 is assigned to one or more of the show elements 174, 176, 180 in the show equipment system 170.

At step 340, one or more cameras (or other image capture devices) 142 are positioned in or near the targeted show area such as near a show portion of a ride or attraction, hidden from view near a waiting area or attraction queue area, along a path in a park, and the like. Two or more cameras 142 may be used in applications where it is difficult for one camera or location to be used to capture image data 160 for riders 156 in a vehicle 154 or group of people in a line. At step 350, the image stream or data 146 from the one or more cameras 142 is transmitted to or provided to an object recognition module 120 for processing with recognition mechanisms 124, 126. At 354, the method 300 continues with determining whether an image was recognized in the digital image data, e.g., whether one of the search objects 136 for the ride/attraction passing by one of the cameras 142 and in a position that allows it to be visually recognized (e.g., the method 300 typically requires at least a partially clear/direct line of sight or vision between one or more of the cameras 142 and the object). If not, the method 300 continues at 350 with the recognition mechanisms 124, 126 attempting to identify the search objects 136 in the vehicle 154 and/or in a targeted show/attraction area.

If an object is recognized, at 360, the method 300 continues with the control system 110 retrieving at least one action set (or show segment script/definition) 138 that has been previously associated with the recognized object. For example, a passenger may be wearing a hat associated with a dog character or figure, and the action set 138 maybe used to cause a character to talk to the passenger (or toward their vehicle) such as by saying a phrase related to the hat (e.g., "I love 'the name of the dog character', too" or "Love your 'name of the dog character' hat" or the like). At 370, the method 300 determines whether the action set 138 uses object tracking to control operation of the associated or assigned show elements. If not, the method 300 continues at 380 with operating the show elements associated or paired with the recognized object to perform the one or more actions defined in the action set 138 retrieved at 360, and the method 300 ends at 390 or continues at 350 (such as by waiting for a next ride vehicle, next group of people walking through a pre-show queue area, and so on).

If tracking is used, the method 300 continues at 386 with the object tracking module 128 of the ride/show control system 110 being used to identify the location of the recognized object relative to the camera(s) 142 and/or show element 174 for which tracking is utilized. In some embodiments, the camera or image sensor is provided as part of the corresponding show element (such as in an eye of a robotic character or the like) so that the relative camera and show element location are the same. The determined location of the tracked object is then fed from the object tracking module 128 to the controller 172 of the show equipment 170 to control operation of one or more of the show elements 174 to follow or react to the current location of the object. For example, such object tracking may be used to allow a robot's eyes to follow or track the object. In other cases, a robotic character may turn their body or head with the object such as to continue to have the character talk or sing to a recognized face or to continue to "attack" a passenger wearing a particular hat or pin/badge. After completing the action set or show profile with object tracking, the method 300 may end at 390 or continue at 350 with processing of additional image data.

Note, in some embodiments of method 300, more than one object may be recognized at a time or nearly concurrently, which may be handled by only performing a first set of actions (e.g., one show portion or action set per vehicle for one or more show elements along a section of track) or, in some cases, by having two or more differing show elements performing action sets 138 concurrently or sequentially. For example, a vehicle 154 may carry a passenger wearing a particular hat and also a passenger with a treasure map (or other action-triggering object). In some cases, the first-to-be-identified object may take precedence and show elements will operate in response to that object while in other cases one object may be given priority and the show elements may perform actions associated with that object (e.g., respond first to the action-triggering, priority object and only to the lower priority object (in this case, a hat) when the action-triggering object is not present/recognized). In other embodiments, differing show elements are assigned to differing trigger objects and perform unique or similar action sets. In the given example, one set of show elements may perform an action set or show profile associated with the hat concurrently with or partially concurrently with a second set of show elements performing another action set or show profile associated with the treasure map. In other cases, the action sets may be performed sequentially by the same (or a different) set of show elements 174, 176, 180.

Figure 4:
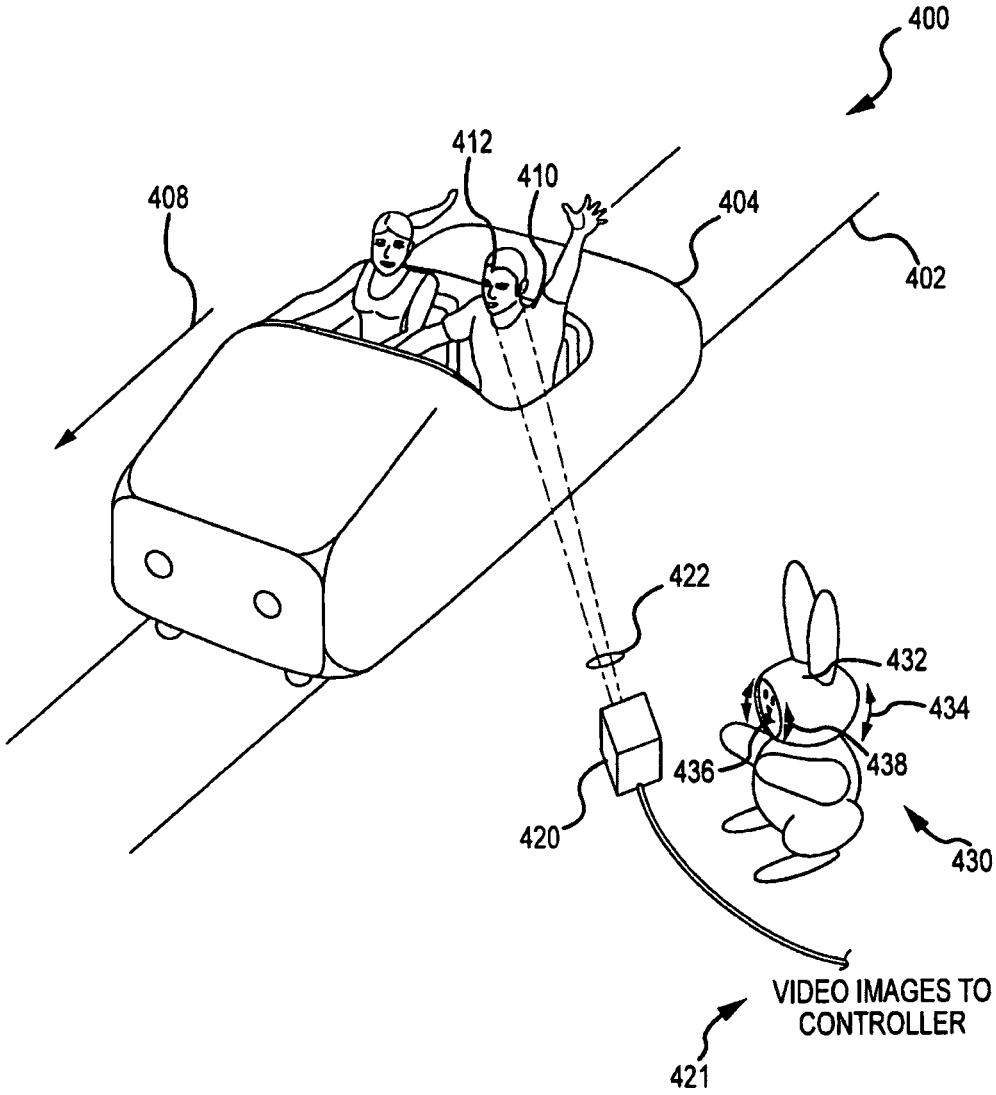
FIG. 4 is a perspective view of a ride system in which object recognition (e.g., a face of a passenger in a vehicle) is used to trigger operation of a show element.

FIG. 4 illustrates a show portion of a ride or attraction system 400 in which the aspects of object recognition-based control of show elements may be utilized to entertain guests or visitors of a theme or amusement park (or other entertainment facility). As shown, the system 400 includes a track 402 and a vehicle 404 riding along at a velocity 408 (such as several feet per second up to 20 miles per hour or more) upon the track 402. A guest or passenger 410 is riding within the vehicle 404 with their face 412 directed forward or toward the front of the vehicle 404 (e.g., visible at locations outside the vehicle at one or more locations along the track 402). A camera 420 is provided along the track 402 to capture still or, more typically, video images 422 that are sent to a controller as shown at 424.

The system 400 also includes a show element 430, which in this case is a robotic character or figure. The controller or control system (not shown in FIG. 4) of system 400 may take the form shown in FIG. 1 and operate as discussed with reference to FIGS. 2 and 3. In such a case, the controller may process the video images 422 to determine if one or more objects in a set of search objects 136 (e.g., 3D objects of interest to a ride designer and/or operator) are recognized as being present in the vehicle 404 by object recognition module (s) or applications 120. The search objects 136 for example, may include a human body part that allows recognition of a human body as the search object such as human face (e.g., not a particular face but any human face as may be recognized by existing real time recognition mechanisms 126), a human arm, a human hand, and so on. In one case, when the controller identifies the face 412 of passenger 410, the controller may act to operate the show element 430 to perform a show or motion profile 138 associated or paired with a face. This may include actions such as causing the character's head 432 to move up and down (or rotate) shown at 434. Concurrently (or separately), the operation of the character 430 in response to a recognized object/face 412 may include causing the figure's mouth 436 to move 438 such as to simulate talking or singing or the like, which may be accompanied by audio output from the figure 430 and/or a separate sound system. In this manner, the system 400 is useful for operating to cause the show element 430 to perform a show routine or profile 138 only when occupied vehicles 404 pass by the camera 420 (and, if the occupants cover their faces, the controller may not recognize the face 412 (or other human body part in other embodiments) and the figure 430 may not be operated in all occupied situations).

Figure 5:
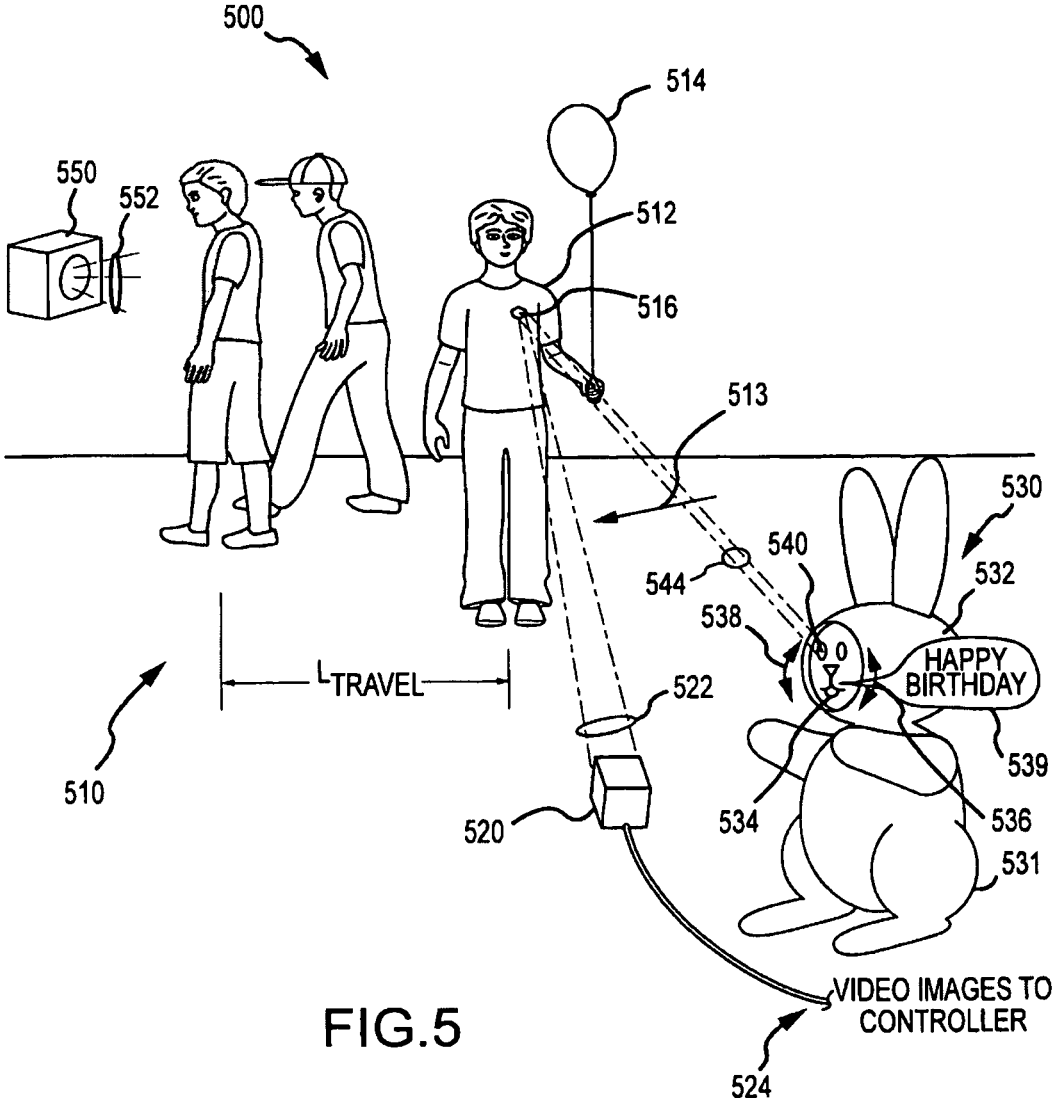
FIG. 5 is a perspective view of another ride system of the invention in which object recognition (e.g., of a balloon and/or a displayed object such as a treasure map or other operator-distributed item, a badge, a pin, other jewelry, or the like) is used to trigger show element functioning and in which object tracking may be used to cause the show element to "follow" an identified object.

FIG. 5 illustrates a portion of a system 500 that may be used in a pre-show area, a queue for an attraction, and/or a path that is traveled by park guests. The system 500 includes a traffic area 510 where it is desired to provide entertainment with a show element 530, which as shown includes a robotic figure operable in response to object recognition. The system 500 includes a camera 520 that captures visual information 522 and transmits digital video or still image data 524 to a controller or show/ride control system (such as the system 110 of FIG. 1). Additionally or alternatively, the show element 530 includes an eye 540 that includes a digital camera or a sensor for capturing images 544 that may also be transmitted to a controller or control system for processing for object recognition. In some embodiments, the control system may be at least in part provided within the body 531 of the robotic character 530 while in others a separate controller/power system is provided in or attached to the body 531 that is in communication with the control system (e.g., similar to systems 110 and 170 of FIG. 1).

During operation of the system 500, image data 522 and/or 544 is captured and processed by the control system. In one embodiment, a defined set of search objects 136 is set by an operator that includes a balloon, and the particular shape or shapes of the balloon 514 may be learned such as using the method 200 of FIG. 2. When a guest or visitor 512 walks past the cameras 520, 540 with the balloon 514, the control system may process the digital image data to determine that the balloon 514 matches a learned or trained object 132 placed by an operator into the search objects 136. In response, the control system may operate to retrieve a choreographed or scripted set of actions or show features 138, and then operate the robotic character 530 to perform the predefined actions. For example, the routine may call for the body 531 to be moved in a particular pattern with the arms flapping/moving. The script may also involve the head 432 being turned 538 while the mouth 534 is opened/closed or moved 536 to simulate talking or signing or other noise making. The movements 536, 538 may be accompanied by lighting effects (not shown) and/or sound as shown output 552 by speaker/sound system 550.

The set of search objects 136 may also include a badge, button, or other worn object 516. Again, this may be an object 132 for which the object recognition module 120 is trained to recognize or it may be a default or known object 134 of the recognition software (e.g., the application may be provided by a developer or designer with a set of known or recognized objects and/or may be configured to recognize a set of objects in real time with one or more algorithms/mechanisms 126 such as to recognize a human face). The badge or pin 516 is associated with differing actions/routines 138 and the control system may operate the robotic figure 530 differently than for the recognized balloon 514. For example, the badge or pin 516 may be provided to all guests 512 of a park or entertainment facility that are celebrating their birthday. Then, the show profile/action set 138 assigned to the badge/pin 516 and used by the control system to operate the show element 530 may involve the character moving 536, 538 to say or sing "Happy Birthday" as shown at bubble 539 to the guest 512 (with sound provided from a speaker on or near the body 531 or separate as shown at with speaker 550). The specific set of actions paired with the object 516 is not limiting to the invention, and it may be varied significantly to achieve a unique experience for the guest 512 (e.g., individualize the experience and/or make them feel special among other guests).

In some embodiments, the system 500 may utilize object tracking along with object recognition. For example, the guest 512 may be wearing or carrying an object 514, 516 that is in a set of search objects 136. The action or show profile 138 associated with such an object 514 or 516 may call for the character 530 to be operated in some manner that requires knowledge of the location of the object 514, 516 relative to the character 530. To this end, the control system 110 used to control/operate the character 530 may include an object tracking module 128, and when an object 514, 516 is recognized by an object recognition module 120 as being in a search set 136, the control system 110 may use the object tracking module 128 to identify the current location of the object 514, 516 and to track its location for a particular distance, $L_{travel}$ as the guest 512 moves within the traffic area 510. The action or routine 138 may call for object tracking, and during execution of the routine 138 the robotic character 530 may be controlled in response to the tracked location such as by turning 538 its head 532 to follow the object 514, 516, to move its eyes 540, turn its body 531, point at or reach for the guest 512, and so on.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the above description stresses or provides more examples on controlling an animated character or mechanized object in response to recognition of an object and/or object tracking. However, the description is intended to cover operating one or more show elements (including a mechanized objects) in response to object recognition and/or tracking. For example, the show elements may be digital media, atmospheric effects (e.g., lighting, fog, wind, fire, temperature, and so on), theater props, and other elements used to create a show or entertainment effect. A significant feature is knowing or determining some aspect or characteristic about the audience (such as a physical aspect, location or the like or something that is interpreted based on an object they carry) and then taking a responsive, specific and appropriate (predefined in some cases or more "random"/variable in others) action based on this known/determined information.

I claim:

1. An apparatus for operating a ride or show element with enhanced interactivity with guests or visitors, comprising:

a mechanized object with one or more movable components, wherein the mechanized object is positioned near a traffic area;

an image capture assembly, spaced apart a distance from the mechanized object, operable to capture images of the traffic area and to output image data; and a control system, physically separate from and spaced apart from the image capture assembly and the mechanized object, with a processor running an object recognition module to process the image data to determine an object is positioned in the traffic area and wherein, in response to the object being determined to be in the traffic area, the control system operates the mechanized object to move at least one of the components, wherein the control system further comprises an object tracking module run by the processor operating to track a physical position of the determined object within the traffic area, wherein the control system performs the operating of the mechanized object to move the one or more movable components at least partially responsive to the tracked physical position, and wherein the determined object includes an item worn or held by a person in the traffic area.

2. The apparatus of claim 1, wherein the control system further comprises memory accessible by the processor storing data related to a set of search objects, the object recognition module being operated during the processing of the image data to recognize the object in the traffic area to determine whether any of the search objects are present in image data based on the stored data.

3. The apparatus of claim 2, wherein the memory stores sets of scripted actions for the mechanized object and the search objects are each associated with at least one of the scripted actions and further wherein the control system operates the mechanized object to perform the at least one of the scripted actions associated with the recognized one of the search objects.

4. The apparatus of claim 3, wherein the mechanized object comprises a robotic figure and the movable components include a mouth and further wherein the operating of the robotic figure comprises moving the mouth based on one of the scripted actions.

5. The apparatus of claim 1, wherein the determined object comprises a human body and the control system operates the mechanized object when the determined object is within the guest traffic area.

6. The apparatus of claim 5, wherein the guest traffic area includes a portion of a track for carrying ride vehicles and the human face is a face of a guest in one of the ride vehicles traveling through the guest traffic area, whereby the mechanized object is only operated for the ride vehicles determined by the control system to be carrying one or more of the guests.

7. The apparatus of claim 1, wherein the operating of the mechanized object includes moving the mechanized object to follow the tracked physical position over a period of time.

8. The apparatus of claim 1, wherein the operating of the mechanized object includes at least one of the following: turning a head of the mechanized object to follow the determined object, moving eyes of the mechanized object, turning a body of the mechanized object, pointing at the determined object at the tracked physical position, and reaching for the determined object with the mechanized object.

9. A method of operating a robotic ride element positioned near a track defining a path for vehicles adapted for carrying one or more passengers, comprising:

operating a camera positioned proximate to the robotic ride element to capture digital image data for vehicles traveling on the track near the robotic ride element;

storing in memory a set of scripted actions for the robotic ride element;

processing the image data using an object recognition module to determine whether a predefined object is present in or proximate to one of the vehicles on the track near the robotic ride element;

when the predefined object is determined to be present in the processing of the image data, operating the robotic ride element to perform the set of scripted actions and concurrently operating one or more of the following components, positioned to be spaced apart from the robotic ride element: robotics, mechanized objects, other show elements, video equipment, audio equipment, lighting systems, and special effects; and processing the image data using an object tracking module to follow a position of the predefined object relative to the robotic ride element over a period of time, wherein the operating of the robotic ride element further includes performing at least some actions based on the position of the predefined object and wherein the predefined object is a wearable or portable object associated with a passenger riding in the one of the vehicles.

10. The method of claim 9, further comprising storing in the memory additional sets of scripted actions for the robotic ride element, wherein each of the sets of scripted actions are associated with differing ones of the predefined object, and wherein the operating of the robotic ride element comprises performing the set of scripted actions associated with the one of the predefined objects determined to be present in the processing of the image data step.

11. The method of claim 10, further comprising storing in the memory data related to a plurality of search objects, wherein each of the search objects is associated with one or more of the sets of scripted actions, and wherein the predefined object comprises at least one of the search objects.

12. The method of claim 9, wherein the predefined object is an object selected from a set of 3D objects learned by the object recognition module prior to the processing of the image data.

* * * * *